US007804472B2

(12) United States Patent
Okada et al.

(10) Patent No.: US 7,804,472 B2
(45) Date of Patent: Sep. 28, 2010

(54) LIQUID CRYSTAL DISPLAY PANEL, STACK TYPE LIQUID CRYSTAL DISPLAY PANEL AND DRIVING METHOD

(75) Inventors: Masakazu Okada, Kyoto (JP); Mitsuyoshi Miyai, Nara (JP)

(73) Assignee: Konica Minolta Holdings, Inc., Tokyo (JP)

( * ) Notice: Subject to any disclaimer, the term of this patent is extended or adjusted under 35 U.S.C. 154(b) by 740 days.

(21) Appl. No.: 11/516,372

(22) Filed: Sep. 5, 2006

(65) Prior Publication Data

US 2007/0109244 A1 May 17, 2007

(30) Foreign Application Priority Data

Sep. 8, 2005 (JP) ..... 2005-260440

(51) Int. Cl.
*G09G 3/36* (2006.01)

(52) U.S. Cl. ..... 345/94

(58) Field of Classification Search ..... 345/87–106, 345/204–215, 690–699; 349/113, 115, 168, 349/175–176, 182–186
See application file for complete search history.

(56) References Cited

U.S. PATENT DOCUMENTS 6,052,103 A * 4/2000 Fujiwara et al. ..... 345/89
6,803,899 B1 * 10/2004 Masazumi et al. ..... 345/101
2003/0043101 A1 * 3/2003 Masazumi et al. ..... 345/87

FOREIGN PATENT DOCUMENTS

| | | |
|---|---|---|
| JP | 10-105085 | 4/1998 |
| JP | 2001-051255 | 2/2001 |
| JP | 2004-030973 | 1/2004 |

OTHER PUBLICATIONS

"31.1: Invited Paper: Reflective Color Display Using Cholesteric Liquid Crystals," Minolta Co., Ltd., Osaka, Japan, by Hashimoto, K., Okada, M., Nishiguchi, K., Masazumi, N., Yamakawa, E., and Taniguchi T., 4 pages, (1998).

* cited by examiner

*Primary Examiner*—Amr Awad
*Assistant Examiner*—Kenneth Bukowski
(74) *Attorney, Agent, or Firm*—Brinks Hofer Gilson & Lione

(57) ABSTRACT

There is provide a low cost liquid display panel with high image quality, the liquid crystal display in which temperature compensation is unnecessary and image quality is not affected by temperature changes of the surrounding environment. In the active matrix cholesteric liquid crystal display panel, the time Tw for applying voltage to the liquid crystal layer at the time of image writing is set so that the variation ΔVs depending on temperature of the writing voltage which makes the liquid crystal layer to show approximate 50% of the maximum reflectance is less than or equal to a predetermined value within a predetermined temperature range.

18 Claims, 6 Drawing Sheets

LIQUID CRYSTAL DISPLAY PANEL, STACK TYPE LIQUID CRYSTAL DISPLAY PANEL AND DRIVING METHOD

This application is based on Japanese Patent Application No. 2005-260440 filed on Sep. 8, 2005, in Japanese Patent Office, the entire content of which is hereby incorporated by reference.

TECHNICAL FIELD

The present invention relates to a liquid crystal display panel, a stack type liquid crystal display panel and a driving method.

BACKGROUND

The liquid crystal display panel has the advantages of low power consumption, thinness, and light weight, and is thus suitable for use in portable devices such as cellular phones, and portable personal computers. Because these devices are operated using built-in batteries, the liquid crystal display devices used therein are required to be as energy efficient as possible. The reflection type liquid display devices do not require a backlight and are thus energy efficient and have good visibility even in bright environments and as a result much is expected from them as the display devices for portable devices.

At present, liquid crystal display devices using nematic liquid crystals which are typically TN and STN are generally used as the reflection type liquid crystal display devices because driving is easy and response properties are good. However, because these liquid crystal display devices have no memory, voltage must be always applied to the liquid crystals throughout the displaying period, and as a result high power consumption is inevitable.

In recent times, liquid crystal display devices which use liquid crystals have been proposed that have memory (called "memory type liquid crystals" hereinafter). These liquid crystals have the feature of semi-permanently displaying the image that has been written after the electric field is no longer applied (memory). That is to say, power is consumed only when the image is re-written, and no power is consumed in order to continue displaying the image. Thus, these liquid crystal display devices are expected to be display devices which consume extremely low amounts of power when used as display devices for displaying still images or text.

Cholesteric liquid crystals and ferroelectric liquid crystals are known as memory type liquid crystals. Cholesteric liquid crystals are excellent in view of image quality and power consumption, but there are problems in that driving is complex and high voltage is required to do the driving for writing and erasing.

A known driving method for cholesteric liquid crystals is the active matrix driving method (see Non-patent Document 1) which includes the simple matrix driving both electrodes between which the liquid crystals comprising pixels are held, are driven by the vertical and horizontal conductive lines respectively and active matrix driving in which in addition to the structure of simple matrix driving, active elements are included in each one of the pixels.

However, in the single matrix driving, the voltage between the conductive lines in the vertical and horizontal directions is applied as it is to the liquid crystals of each pixel of the liquid crystal matrix, and thus in the cholesteric liquid crystal, voltage must be continuously applied between the conductive lines for the time required for writing each pixels. In this manner, voltage is applied successively for a predetermined time to each of the pixels and thus the writing speed is slow.

On the other hand, in active matrix driving, a TFT (thin film transistor) is formed as a liquid crystal substrate and voltage is applied to each pixel via the TFT. For this reason, after the TFT comes ON and voltage is applied, the pixel is in a floating state when the TFT goes OFF, and the voltage that is charged to the stray capacitance of the liquid crystal layer or the auxiliary capacitor that is provided and application of voltage to the liquid crystal layer is continued. For this reason, it is sufficient for the time for applying voltage to the pixels via the TFT to be the same time for charging stray capacitance of the liquid crystal layer or for the stray capacitance of the liquid crystal layer and the auxiliary capacitor, and thus high speed scanning is made possible by applying voltage to each successive pixel. For example, the technology for driving cholesteric liquid crystals using active matrix driving is disclosed in Japanese Unexamined Laid-Open Patent Publication No. H10-105085.

In addition, the cholesteric liquid crystals have temperature characteristics, and there is a problem in that when driving is done using a pulse voltage that always has the same voltage value and pulse width, the display state varies due to temperature. In Japanese Unexamined Laid-Open Patent Publication No. 2001-51255 and Japanese Unexamined Laid-Open Patent Publication No. 2004-30973 a method for keeping the display state fixed by adjusting the pulse voltage or the pulse width in accordance with the temperature of the surrounding environment for temperature compensation is disclosed.

[Non-Patent Document 1] SID '98 Hashimoto: Minolta (International Symposium Digest of Technical Papers Volume 29, Page 897, 1998)

However, as shown in Japanese Unexamined Laid-Open Patent Publication No. 2001-51255 and Japanese Unexamined Laid-Open Patent Publication No. 2004-30973, in the method in which the pulse voltage or the pulse width is adjusted in accordance with temperature changes of the surrounding environment, there is a problem in that a temperature detection means and a temperature control means become necessary and the pulse drive control circuit and the pulse drive circuit become complex.

SUMMARY

The present invention was conceived in view of the above-described problems and an object thereof is to provide a liquid crystal display panel, a stack type liquid crystal display panel and a driving method for these, in which by making the time for executing the image writing period suitable, temperature compensation is unnecessary, image is not affected by temperature changes of the surrounding environment and image quality is high and cost is low.

In view of forgoing, one embodiment according to one aspect of the present invention is a liquid crystal display panel, comprising:

a plurality of pixel electrodes which are arranged in a matrix;

an active matrix substrate which includes switching elements for controlling application and interruption of a voltage to the pixel electrodes;

an opposing substrate which includes a common electrode opposing the pixel electrodes; and a liquid crystal layer disposed between the pixel electrodes and the common electrode, the liquid crystal layer showing cholesteric phase at a temperature of 25° C., wherein different voltages is applied to the liquid crystal layer in each of an image erasing period, an image writing period and an image displaying period, and thereby a state of the liquid crystal layer is changed in an order of erasing an image, writing an image and displaying an image, wherein a time period Tw of applying a writing voltage to the liquid crystal layer during the image writing period is set so that a variation ΔVs by temperature change of the writing voltage which is applied to the liquid crystal layer in order to write an image showing approximate 50% of a maximum reflectance is less than or equal to a predetermined value within a predetermined temperature range.

According to another aspect of the present invention, another embodiment is a liquid crystal display panel, comprising:

a plurality of pixel electrodes which are arranged in a matrix;

an active matrix substrate which includes switching elements for controlling application and interruption of a voltage to the pixel electrodes;

an opposing substrate which includes a common electrode opposing the pixel electrodes; and a liquid crystal layer disposed between the pixel electrodes and the common electrode, the liquid crystal layer showing cholesteric phase at a temperature of 25° c., wherein different voltages being applied to the liquid crystal layer in each of an image erasing period for resetting the liquid crystal layer included in an area for writing into a predetermined state so as to erase an image, an image writing period for writhing an image and an image displaying period for displaying an image, wherein a time period Tw of applying a writing voltage to the liquid crystal layer during the image writing period is set longer than or equal to a time period with which a difference between the writing voltage at 0° c. and the writing voltage at 50° c., both voltages for making the liquid crystal layer display an image of approximate 50% of a maximum reflectance, is 10% of a difference between a maximum and minimum writing voltages at a temperature of 25° c.

According to another aspect of the present invention, another embodiment is a driving method for a liquid crystal display panel comprising a plurality of pixel electrodes arranged in a matrix, an active matrix substrate including switching elements for controlling application and interruption of a voltage to the pixel electrodes, an opposing substrate including a common electrode opposing the pixel electrodes, and a liquid crystal layer disposed between the pixel electrodes and the common electrode, the liquid crystal layer showing cholesteric phase at a temperature of 25° c., the driving method comprising the steps of:

applying a voltage to the liquid crystal layer to erase an image;

applying a writhing voltage to the liquid crystal layer to write an image;

applying a voltage to the liquid crystal layer to display an image;

wherein a time period Tw of applying the writing voltage to the liquid crystal layer is set so that a variation ΔVs by temperature change of the writing voltage which is applied to the liquid crystal layer in order to write an image showing approximate 50% of a maximum reflectance is less than or equal to a predetermined value within a predetermined temperature range.

DETAILED DESCRIPTION OF THE PREFERRED EMBODIMENT

The embodiment of the present invention will be described using the drawings.

Figure 1:
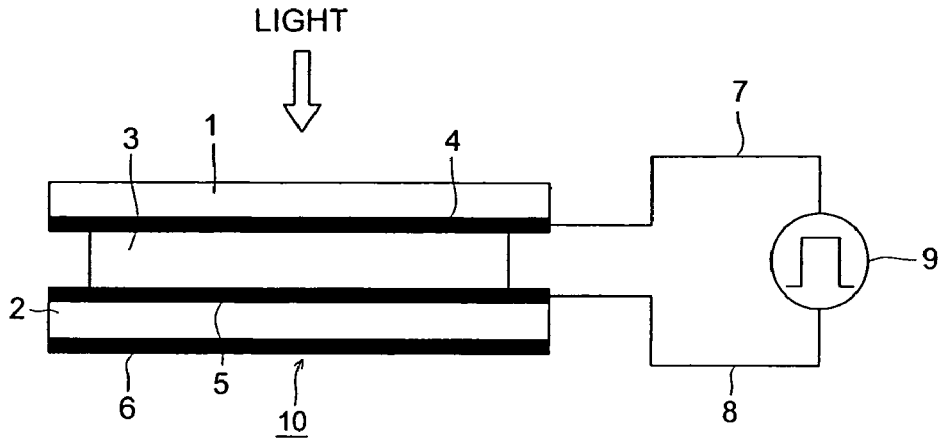
FIG. 1 shows the configuration of the liquid crystal cell for explaining the operation of the cholesteric liquid crystal.
Figure 2:
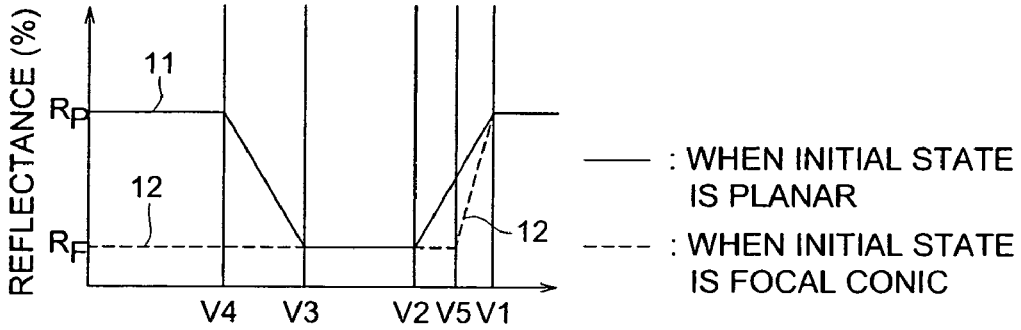
FIG. 2 shows the changes in the reflectance when voltage is applied to the liquid crystal cell for explaining the operation of the cholesteric liquid crystal.

FIG. 1 is a basic configuration diagram of the liquid crystal cell 10, and FIG. 2 shows the changes in the reflectance when voltage is applied to the liquid crystal cell 10.

In FIG. 1, 1 and 2 are glass substrates; 3 is the liquid crystal layer of a cholesteric liquid crystal; 4 and 5 are transparent electrodes formed of ITO and the like; and 6 is a light absorbing layer formed of black coating and the like. The transparent electrodes 4 and 5 respectively are connected to the power source 9 by conductive lines 7 and 8.

FIG. 2 shows the reflectance of the liquid crystal cell 10 when measured from the observation surface (the surface opposite to the light absorbing layer 6) of the liquid crystal cell, when voltage has been applied to the liquid crystal cell 10. In FIG. 2, the horizontal axis shows the voltage applied to the liquid crystal cell 10 and the vertical axis shows the reflectance of the liquid crystal after the voltage is removed. The solid line 11 shows the reflectance of the liquid crystal 10 measured when the crystal is stable after the voltage is applied to the planar state liquid crystal 10 and then removed. The broken line 12 shows the reflectance of the liquid crystal cell 10 measured when the crystal becomes stable after the voltage is applied to the liquid crystal in the focal conic state and then removed. The broken line 12 overlaps with the solid line 11 between the voltages V3 and V2 and above V1.

The driving principle of the cholesteric liquid crystal will be described in the following. The cholesteric liquid crystal shows three liquid crystal phases which are the homeotropic (nematic) state, the planar state and the focal conic state. The homeotropic state is a liquid crystal state that is shown only when voltage is being applied to the liquid crystals, and the longer axis of the liquid crystal molecules (called liquid crystal axis hereinafter) line up in the direction of the electric field and the liquid crystal layer becomes transparent.

The planar state is a phase that is shown when voltage is applied and the homeotropic state is shown and then the electric field that is being applied is suddenly removed and the liquid crystal molecules become oriented in a helical state and the liquid crystal molecules become oriented in a helical state and the center axis of the helix (called helical axis hereinafter) is a state perpendicular to the substrate. At this time, in the case where light is entered from the direction parallel to the helical axis, the light of wavelength shown by $\lambda=n\cdot p$ is selectively reflected, and light that is shorter than this is transmitted. Here $\lambda$ is the selected reflection wavelength, n is the average refraction index of liquid crystal molecules, and p is the distance where the liquid crystal molecule is twisted by 360° (helical pitch). At the time of this planar state, when a suitable voltage is applied to the liquid crystal layer, the liquid crystal is in a state in which the helical axis is oriented in the direction parallel with the substrate, or in other words, in the focal conic state. At this time, the light that is entered from the direction perpendicular to the helical axis, or in other word the direction perpendicular to the substrate, light whose wavelength is close to the helical pitch p is transmitted without being reflected or scattered, but light which is shorter than this is scattered.

Thus, by setting the selected reflection wavelength within the visible region and setting light absorbing layer at the side opposite to observation side of the element, selected reflection colors can be displayed in the planar state and black can be displayed in the focal conic state. In addition, by setting the selected reflection wavelength within the infrared region and setting light absorbing layer at the side opposite to the observation side of the element, in the planar state light of the wavelength of the infrared region can be reflected, but light of the wavelength of the visible region is transmitted so black is displayed and in the focal conic state, white display due to scattering of the visible light is possible.

The choleric liquid crystal has hysteresis properties and as described above, even if the same voltage is applied, the state will be different depending on the state prior to voltage application. Thus, as is the case for cholesteric liquid crystals, when writing is being done on the liquid crystals having hysteresis properties, initialization must be done to cause a particular state.

First, the solid line 11 will be described. At the solid line 11, the liquid crystal prior to voltage application is in a planar state and the reflectance shows $R_P$. A pulse voltage of a width of 5 ms for example is applied from the power source 9 to the liquid crystal cell 10. If the voltage applied is V4 or less, there is little or no change in reflectance of the liquid crystal cell 10 after applying the pulse voltage. This voltage is called the planar voltage.

When the voltage is between V3 and V4, the reflectance decreases as the voltage is increased, and in this range the liquid crystal layer 3 is in a state in which the planar state and the focal conic state are mixed, and at voltage V3 most of the liquid crystal layer 3 is in the focal conic state. The voltage V3 is called the focal conic voltage.

When voltage is in the range from V3 to V2, there is little or no change in reflectance. When the voltage is the range from V2 to V1, reflectance increases as voltage increases. In this range the planar state and the focal conic state are mixed.

At voltage V1, the liquid crystal layer 3 is mostly in the planar state. When the voltage is higher than V1, even if the voltage is increased, reflectance does not change. In this range, the liquid crystal layer is in the homeotropic state when voltage is applied, and voltage V1 is called he homeotropic voltage. By utilizing these characteristics, voltage exceeding V1 is applied to the liquid crystal layer 3 and after the liquid crystal layer 3 is temporarily initialized to the planar state, when voltage from V4 to V3 or voltage from V2 to V1 is applied to liquid crystal layer 3, an image of a suitably selected density can be displayed on the liquid crystal layer 3.

Next the broken line 12 will be described. At the broken line 12, the liquid crystal prior to voltage application is in a focal conic state and the reflectance shows $R_F$. A pulse voltage of a width of 5 ms for example is applied from the power source 9 to the liquid crystal cell 10. If the voltage applied less than V5, there is little or no change in reflectance of the liquid crystal cell 10 after applying the pulse voltage. The liquid crystal layer 3 remains in the focal conic state. When the voltage is in the range between V5 and V1, the reflectance increases to as the voltage is increased. In this range the liquid crystal layer 3 is in a state in which the planar state and the focal conic state are mixed. At voltage V1 most of the liquid crystal layer 3 is in the planar state. When the voltage is higher than V1, even if the voltage is increased, reflectance does not change. In this range, the liquid crystal layer is in the homeotropic state when voltage is applied. By utilizing these characteristics, when voltage from V3 to V2 is applied to the liquid crystal layer 3 and after the liquid crystal layer is temporarily initialized to the focal conic state, voltage from V5 to V1 is applied to liquid crystal layer 3, an image of a suitably selected density can be displayed on the liquid crystal layer 3.

First Embodiment

Figure 3:
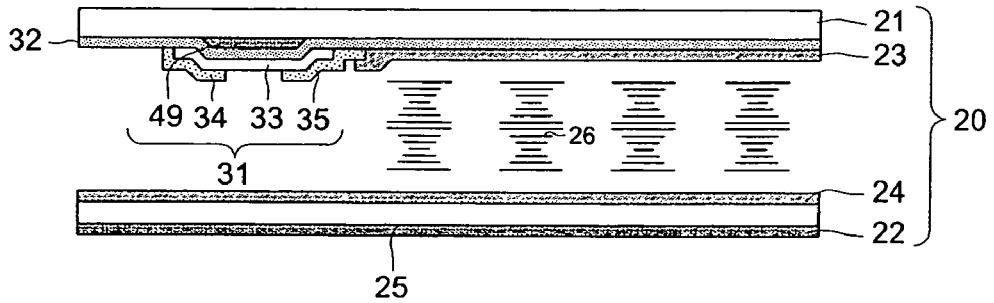
FIG. 3 is a cross-sectional view of the liquid crystal display panel 20 of the first embodiment of the present invention.

FIG. 3 is a cross-sectional view of the liquid crystal display panel 20 of the first embodiment of the present invention.

A pixel electrode 23 is formed in a matrix state on the active matrix substrate 21 and the pixel electrode 23 is connected to a bottom gate-top contact type TFT31 as the switching element. The source electrode 34 of TFT31 is connected to a signal line (not shown) and the drain electrode 35 of TFT31 is connected to the pixel electrode and the gate electrode 49 of TFT31 is connected to the scanning line (not shown).

The configuration of TFT31 includes the gate electrode 49 which is provided on the active matrix substrate 21; the gate insulating film 32 which is provided on the gate electrode 49, the semiconductor layer 33 which is provided or the gate insulating film; the source electrode 34 and the drain electrode 35 which are in contact with the semiconductor layer. In addition, a protective layer that is formed from an insulating material may be provided so as to cover TFT31 in order to protect TFT31.

An opposing substrate 22 where a common electrode 24 is formed is provided as opposing side, and a liquid crystal layer 26 which shows a cholesteric phase is disposed between the active matrix substrate 21 and the opposing substrate 22 at room temperature. Various organic or inorganic functional films (not shown) such as an alignment film layer for controlling the alignment of the liquid crystal layer and an insulating layer for preventing shorting between the upper and lower electrodes may be provided at the upper and lower electrodes.

The black absorption layer 25 is provided at the side opposite to the electrode of the opposing substrate 22. In this embodiment, the absorption layer 25 is provided at the opposing electrode side and observed from the TFT substrate side, but the black absorption layer 25 may be disposed at the TFT substrate side and observation may be done from the opposing substrate 22 side.

<Substrate Material>

The active matrix substrate 21 of FIG. 3 may use hard transparent substrates which have been used in electronic devices, such as soda lime glass, no-alkali glass, quartz, silicon wafers and the like, and flexible plastic films may also be used as the substrate. Films made from polyethylene terephthalate (PET), triacetyl cellulose (TAC), cellulose acetate propionate (CAP), polycarbonate (PC), polyether sulfon (PES), polyethylene naphthalate (PEN), polyimide (PI) and the like may used as the plastic substrate, and known surface coats may be applied to these films or they may be subjected to known surface processing.

<Electrode Material>

Low resistance metals such as Al, Cr, Ta, Au, Ag, Cu, Pt, Mo and the like are effective as the material for the gate electrode 49 of FIG. 3, and low concentration doping or multilayer lamination may be performed in view of improving adhesion to the substrate and reducing defects as well as improving durability of the material.

Conductive high polymer films which are typically transparent conductive films that are widely used industrially such as doped indium tin oxide (ITO), doped indium zinc oxide (IZO) and $SnO_2$ and the like as well as polyethylenedioxythiophene: polystyrenesulfonate (PEDOT:PSS) may be used as the pixel electrode 23.

<Insulating Material>

Various insulating substances may be used as the material for the gate insulating film 32, but inorganic oxide thin films, nitride thin films and oxynitride thin films are preferable. Examples of the inorganic oxide include silicon oxide, aluminum oxide, tantalum oxide, and vanadium oxide, but silicon oxide is particularly advantageous in view of the fact that semiconductor manufacturing technology that has been widely used in the past can be applied. Silicon nitride is suitable as the nitride film and silicon oxynitride is suitable as the oxynitride for the same reason given above. Organic materials such as polyimide and polyvinyl alcohol and the like may be used.

<Semiconductor Material>

Amorphous silicone is most preferable as the material for the semiconductor layer 33 in view of its properties and large surface area, but polysilicone which has a high mobility may also be used and organic material such as pentacene may also be used.

<Liquid Crystal Material>

A chiral nematic liquid crystal which shows a cholesteric phase at room temperature may be used as the liquid crystal layer 26. The chiral nematic liquid crystal is obtained by adding a chiral material to nematic liquid crystals. In the case where the chiral material is added to the nematic liquid crystals, it has the effect of twisting the nematic liquid crystal molecule and by adjusting the amount that is added, the selected reflection wavelength of the liquid crystals can be controlled.

<TFT Drive Method/Waveform>

Figure 4:
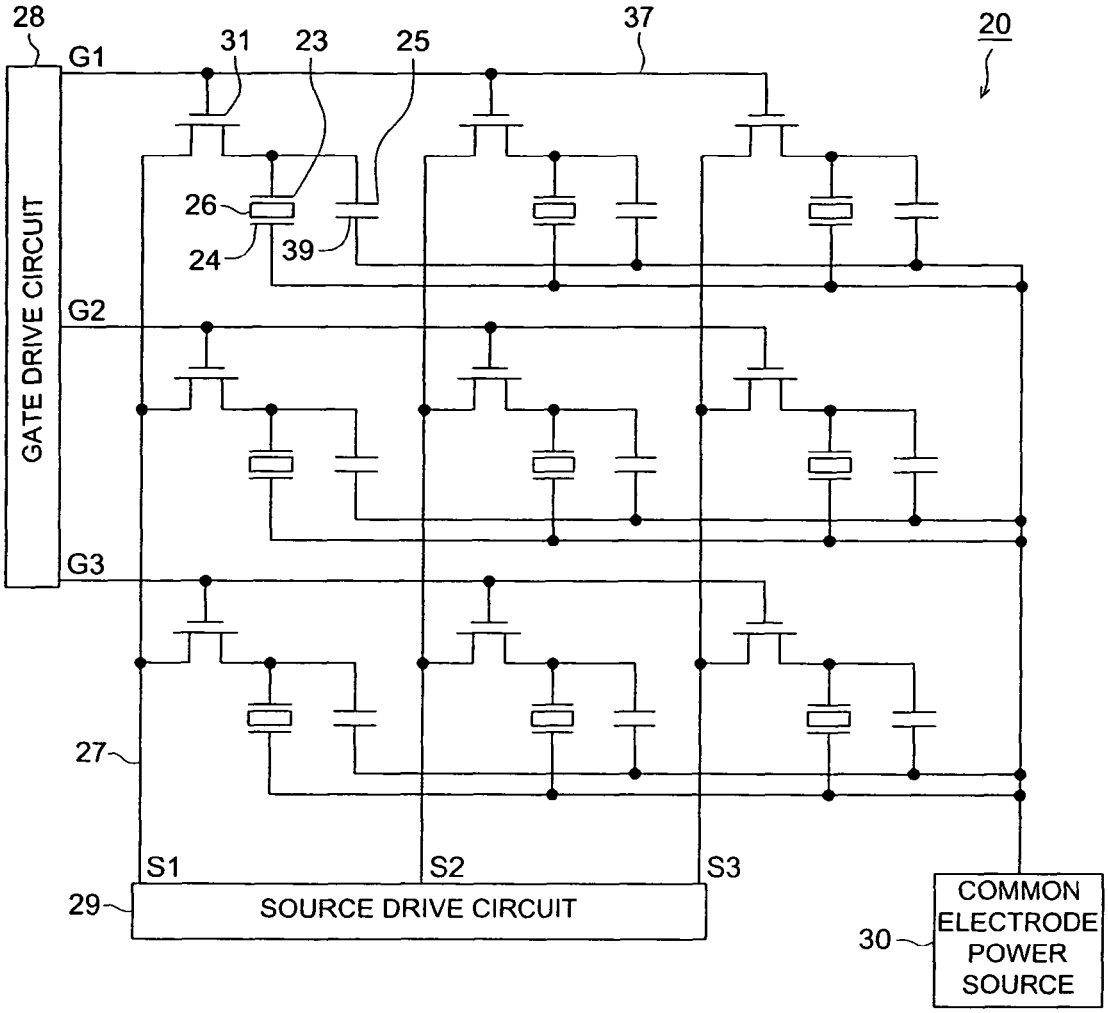
FIG. 4 shows the configuration of the liquid crystal display panel 20 of the first embodiment of the present invention.

FIG. 4 shows the configuration of the liquid crystal display panel 20 of the first embodiment of the present invention. In the drawing, the configuration of a liquid crystal display device having 3 columns ×3 rows of pixels is shown for ease of explanation, but the present invention is not limited to this number of pixels. In FIG. 4, 31 is the TFT31 (switching element) which controls application and interruption of voltage to the pixel electrode 23 and the pixel electrode 23 nips the liquid crystal layer 26 between itself and the common electrode 24. 25 is the auxiliary capacitor and the electrode which is close to TFT31 is formed by a part of the pixel electrode 23, and the auxiliary electrode 39 which is the other electrode is connected to the common electrode 24, and operates such that when TFT31 is in the interrupted state, the voltage that is applied to the pixel electrode 23 is maintained. The pixel electrode 23, the common electrode 24, the liquid crystal layer 25 and the auxiliary capacitor 25 form one pixel. 37 is the gate line and it connects each of the TFT31 gates of the pixels arranged in the column direction to each other and is connected to the gate drive circuit 28. 27 is the source line and it connects each of the TFT31 sources of the pixels arranged in the row direction to each other and is connected to the source drive circuit 29. Gate lines G1, G2 and G3 are connected to the gate drive circuit 28 and ON/OFF control of TFT31 is performed by output of voltage to these gate lines, and the row to which voltage is applied is thereby selected. The source lines S1, S2 and S3 are connected to the source drive circuit 29 and the voltage to be applied to the pixel electrode 23 of the selected row is output to these source lines. 30 is the common electrode power source and the required voltage is applied to the auxiliary electrode 39 which is one of the common electrode 24 and the auxiliary capacitor that is connected to a common electrode 24.

In the first embodiment of the present invention, the properties of the TFT31 are such that the gate voltage to make the TFT31 be in the ON state is 50V and the gate voltage to make the TFT31 be in the OFF state is −5V. Also, in this embodiment, the properties of the cholesteric liquid crystals are such that V1=40V, V2=30V, V3=20V, V4=10V and V5=35V.

Figure 5:
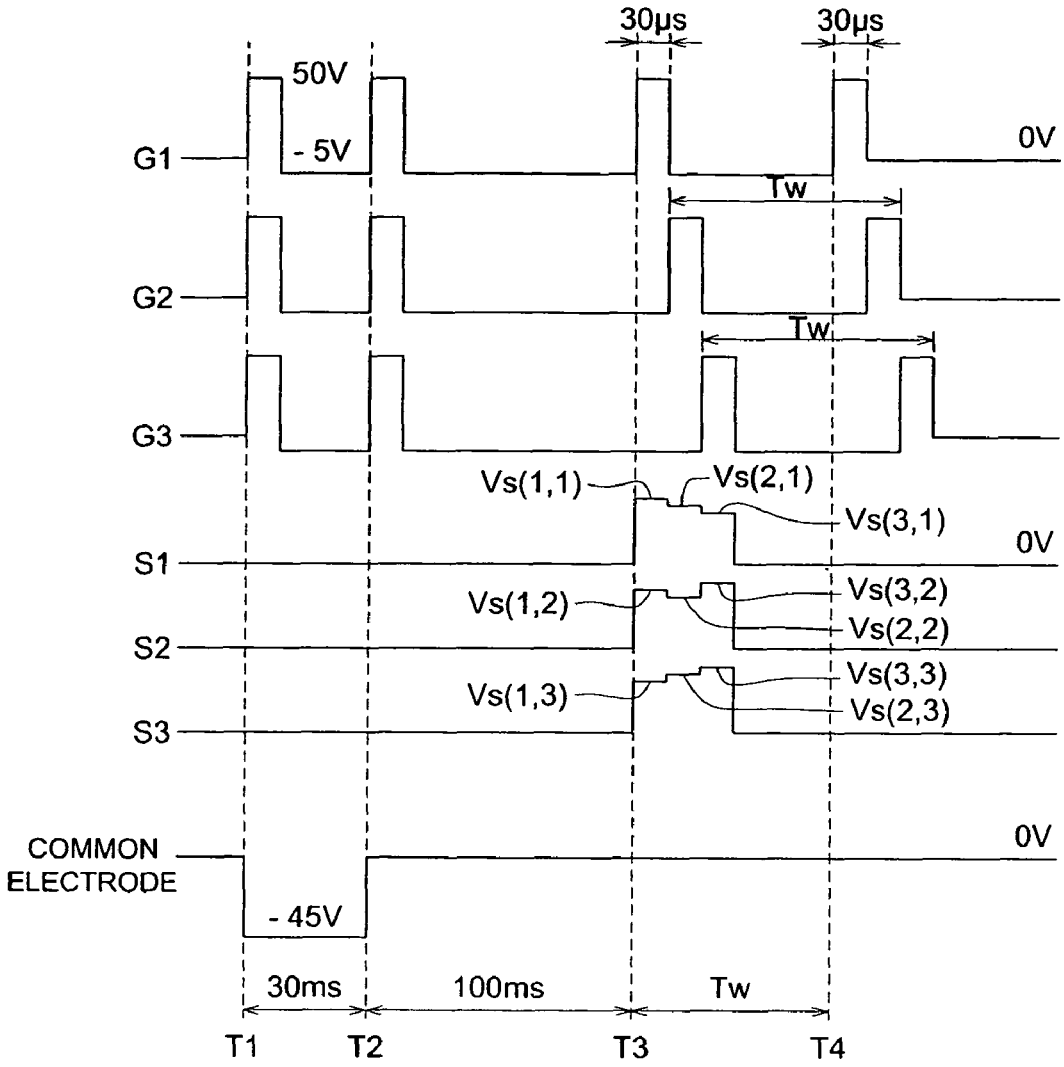
FIG. 5 is a graph showing the changes in voltage for each portion of the liquid crystal display panel of the first embodiment of the present invention.

FIG. 5 is a graph showing the changes in voltage for each portion of the liquid crystal display panel of the first embodiment of the present invention during the erasing period, the writing period and the displaying period. The operation of the liquid crystal display device will be described using FIG. 5.

In FIG. 5, G1, G2 and G3 indicate the voltage of gate lines G1, G2 and G3 respectively and S1, S2 and S3 indicate the voltage of source lines S1, S2 and S3 respectively, and common electrode indicates the voltage of the common electrode 24. The timings T1, T2, T3 and T4 are the timings for rising of the voltage for the gate line G1, and timing T1 is the start time for the erasing period, the timing T3 is the start time for the writing period, and the timing T4 is the start time for the displaying period.

(Erasing Period)

In FIG. 5, firstly, at the timing T1, a voltage of 50V for example is output to the gate lines G1, G2 and G3 and TFT31 comes ON, and the voltage of the source lines S1, S2 and S3 is applied to the pixel electrode 23. Subsequently, a voltage of −5V is output and TFT31 comes OFF. A voltage of 50V is output to the gate lines and simultaneously a voltage of −45V whose absolute value is larger than the homeotropic voltage V1 is output to the common electrode 24. The source line remains at 0V. The period for which 50V is output to the gate lines G1, G2 and G3 and TFT31 is ON can be any time which is sufficient for the liquid crystal layer 26 and the auxiliary capacitor 25 to be charged via TFT31 and a several tens of μs for example is sufficient. As a result, a voltage of 45V is applied to the liquid crystal layer 26 and the liquid crystal layer 26 achieves a homeotropic state. In FIG. 5, this voltage is kept for 30 ms and the liquid crystal layer sufficiently maintains a homeotropic state.

Subsequently, at the timing T2, 50V is temporarily output to gate lines G1, G2 and G3, and the TFT31 which is connected to the gate lines G1, G2 and G3 comes ON and then −5V is output and TFT31 goes OFF. A voltage of 50V is output to the gate lines and simultaneously 0V is output to the common electrode 24. The period for which 50V is output to the gate lines G1, G2 and G3 and TFT31 is ON can be any time which is sufficient for the liquid crystal layer 26 and the auxiliary capacitor 25 to be charged via TFT31 and a several tens of Ps for example is sufficient. As a result, a voltage of 45V is applied to the liquid crystal layer 26 and the applied voltage suddenly becomes 0 and thus the liquid crystal layer 26 changes from a homeotropic state to a planar state and is initialized. At this time, the liquid crystal layer 26 does not achieve the planar state instantaneously, but rather changes to the planar state after it once shows a planar state called the transient planar state that has twice the original helical pitch. The time required for changing from the homeotropic state to the planar state is about 1 ms. Thus, the writing period may start 1 ms after the voltage applied to the liquid crystal layer becomes 0V, but in this embodiment the writing period starts 100 ms after. The reason the writing period is not started immediately after the liquid crystal layer achieves the planar state will be given below.

(Writing Period)

At the timing T3, the voltage of the gate line G1 is set at 50V and the writing period is started. At this time, voltages from V4 to V3 described in FIG. 2 which correspond to the density of writing on the pixel is output to the source lines S1, S2 and S3.

While the gate lines G1, G2 and G3 successively becomes 50V after T3 and the TFT31 at the corresponding columns come ON, the voltage of S1 changes Vs (1, 1), Vs (2, 1), Vs (3, 1) at the same timing. Vs (x, y) refers to the writing voltage that is applied to the pixel electrode 23 of x column, y row, and for example Vs (1, 1) is the writing voltage that is applied to the pixel electrode for the first column and first row.

On the other hand, the voltage of the common electrode 24 is 0V and thus the voltage Vs (x, y) is applied to the liquid crystal 26 of the xth column, yth row.

The absolute value of Vs (x, y) is output in the voltage range substantially from V4 to V3 described in FIG. 2 in accordance with density of the writing on each of the pixels. In this embodiment, V4=10V and V3=20V, so the range is approximately 10V.

In the example of FIG. 4, in the case of the pixel of the 1st column, 1st Vs (1, 1)=20V is applied to the liquid crystal layer 26 of the pixel. Vs (1, 2)=15V and (1, 3)=10V are applied to the corresponding pixel.

The period for which 50V is output to the gate line G1 and TFT31 is ON can be any time which is sufficient for the liquid crystal layer 26 and the auxiliary capacitor 25 to be charged via TFT31 and is 30 μs for example in this embodiment. Subsequently, −5V is output to the gate line G1 and TFT31 achieves the OFF state. In this manner, the voltage that is applied to the liquid crystal layer 26 is maintained until after Tw (ms) where the gate line G1 is 50V, and a portion of the liquid crystal molecules of the liquid crystal layer 26 converts to the focal conic state and writing is done in accordance with the voltage that is applied.

Tw is the time for applying the voltage for writing an image onto the liquid crystal layer of each pixel. The voltage that is applied during Tw is maintained between both ends of the liquid crystal layer 26 by the stray capacitance of the liquid crystal layer 26 or the separately provided auxiliary capacitor 25. As is later described in detail, the liquid crystal layer 26 has temperature characteristics and at Tw which is less than a predetermined time Tx, even if the same voltage is applied to the liquid crystal layer 26, there are great changes in density depending on temperature. The method for determining the predetermined time Tx will be described in detail hereinafter. Tw must be greater than or equal to Tx in order to perform favorable display that is not affected by temperature. In this embodiment, Tx is 30 ms.

In this embodiment, the width of the pulse voltage that is applied to the gate lines G1, G2 and G3 at the writing period is 30 μs. Thus, if the number of columns of the pixels in the liquid crystal display device is assumed to be 500 lines for example, the writing period scanning takes 15 ms. Tw must be greater than 15 ms which is the writing period scanning time and also greater than Tx. Because Tx is 30 ms in this embodiment as mentioned above, Tw is set with some latitude and is set to 100 ms. In this case, erasing period takes 30 ms, the writing period takes 100 ms and the scanning for the displaying period takes 30 ms, and thus the image can be rewritten in a total of 160 ms.

The voltages of the gate lines G1, G2 and G3 in the writing period are output at 50V pulse voltage in the order G1, G2 and G3 and gate lines G1, G2 and G3 are scanned and writing is successively performed on the pixels of the columns to which the 50V pulse has been applied.

It is to be noted that in the case where a portion of the screen is rewritten, only the pixels that are to be re-written should be scanned.

The reason the writing period is not started immediately after the liquid crystal layer 26 is initialized to the planar state will be explained. The period from timing T2 to T3 is the time required for the liquid crystal layer 26 to become stable. The alignment of the liquid crystal molecules is not stable for a short time after the liquid crystal layer 26 achieves the planar state. As is the case in this embodiment, if each of the columns is scanned and the writing period is executed after the pixels to be initialized are initialized simultaneously, the time from initialization to when the writing period starts varies between the pixels. Thus, if the writing period is started a short time after initialization to the planar state, the time from initialization to the writing period varies between the pixels and so the possibility of unevenness in the display exists. For this reason it is preferable to wait until the alignment of the liquid crystal molecules after alignment is sufficiently stable before executing the writing period. It is preferable that this wait time is 50 ms or greater.

(Displaying Period)

From the timing T4 which is 30 ms after the timing T3, 50V pulse voltage is successively applied to the gate lines G1, G2 and G3 and the TFT31 connected to the gate lines G1, G2 and G3 successively come ON. At this time, voltage of 0V is applied to the source lines S1, S2 and S3 and the common electrode 24 and the voltage applied to the liquid crystal layers 26 successively become 0V. It is sufficient for the period of the 50V pulse voltage to be the time for the voltage of the liquid crystal layer 26 and the auxiliary capacitor 25 to be charged via TFT31 and is set to 30 μs for example in this embodiment. In this manner, the voltage applied to the liquid crystal 24 becomes 0V and the displaying period of the liquid crystal display device begins.

EXAMPLE 1

Example 1 which was carried out for confirming the effects of this embodiment will be described in the following.

[Fabrication of the Liquid Crystal Panel]

The liquid crystal material is prepared by sufficiently mixing 78.0 weight % of nematic crystals ZLI-1565 (manufactured by Merck & Co., Inc.) with positive dielectric anisotropy, 14.0 weight % of dextrorotatory chiral agent CB15 (manufactured by Merck & Co., Inc.) and 5.0 weight % of dextrorotatory chiral agent R-1011 (manufactured by Merck & Co., Inc.) to fabricate a dextrorotatory green reflective liquid crystal composition.

Next the formed active matrix substrate 21 of the pixel electrode 23 that was prepared in advance and the formed opposing substrate 22 of the common and then the 24 are used and the substrates are adhered with a substrate gap of 4 μm and then the green reflective liquid crystal composition is filled in using a vacuum injection method.

[Experiment Conditions]

After the erasing period described in FIG. 5, pulse voltage is applied successively to the gate lines G1, G2 and G3 from the timing T3 and the voltage Vs (x, y) is applied successively to each pixel electrode.

Vs (x, y) has the same voltage as the pixel electrodes and are in the range of 10-40V and are changed by 0.2 V at a time and the reflectance of the entire liquid crystal display panel 20 is measured.

Measurement temperature: 0° C., 25° C., 50° C.

[Experimental Results]

Figure 6:
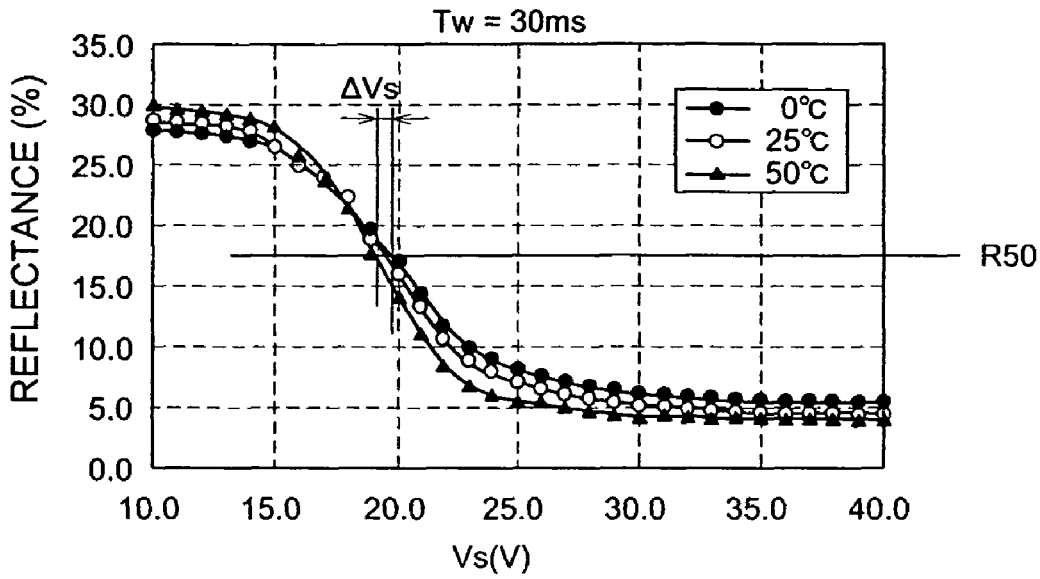
FIG. 6(*a*) and FIG. 6(*b*) are graphs showing the relationship between the writing voltage Vs that is applied to the pixel electrode and the reflectance of the liquid crystal display panel 20 of example 1 of the present invention.
Figure 6:
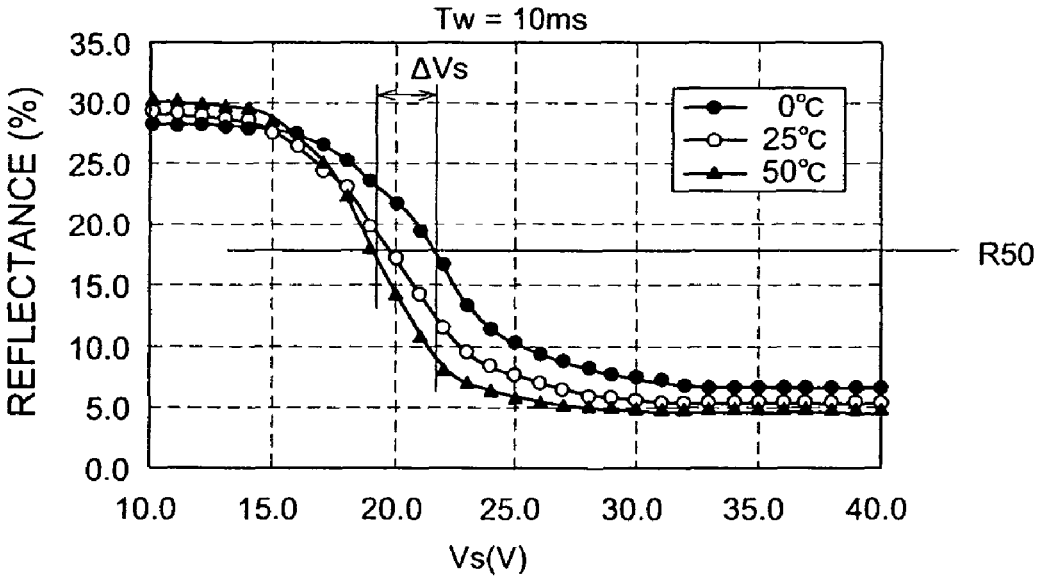
Figure 7:
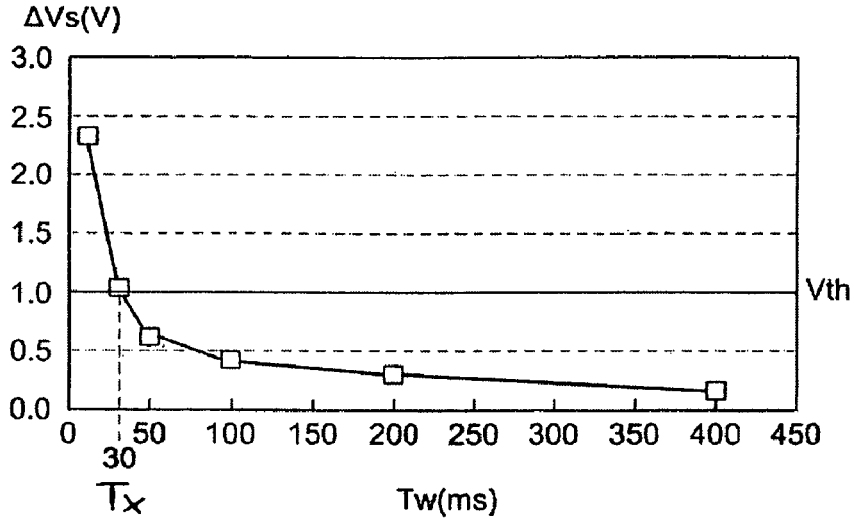
FIG. 7 shows experimental results which show the relationship between Tw and ΔVs of example 1 of the present invention.

The experimental results are shown in FIG. 6(*a*), FIG. 6(*b*) and FIG. 7.

FIG. 6(*a*) and FIG. 6(*b*) are graphs showing the relationship between the writing voltage Vs that is applied to the pixel electrode and the reflectance of the liquid crystal display panel 20 of example 1 of the present invention. The experiment is carried out under two conditions where the times for applying voltage for writing the image onto the liquid crystal layer are Tw=30 ms and Tw=10 ms. FIG. 6(*a*) shows the results of the measurements when Tw=30 ms and FIG. 6(*b*) shows the results of the measurements when Tw=10 ms.

Here 50% reflectance with respect to the maximum reflectance is called R50. R50 is the reflectance that expresses the halftone of the image and is important for good image expression. Further, the absolute value of the difference between the writing voltage Vs (50° C.) for obtaining reflectance R50 when the temperature is 50° C. and the writing voltage Vs (0° C.) for obtaining reflectance R50 when the temperature is 0° C. is called ΔVs.

When Tw=10 ms in FIG. 6(*b*), it is clear that there are large changes in the voltage Vs for obtaining reflectance R50 due to temperature change. Reproducing the halftone is important for good image expression, and when tone changes due to temperature change, this results in the image quality being greatly deteriorated. On the other hand, in FIG. 6(*a*) when Tw=30, there is little or no change in tone due to temperature change.

FIG. 7 is the results of experiments which show the relationship between Tw and ΔVs in example 1 of the present invention.

The time of applying the voltage for writing an image on the liquid crystal layer is changed within the range from 10 ms to 400 ms and ΔVs is measured. Here a limit of ΔVs with which variation in image quality due to temperature is allowable, is set as the threshold voltage Vth. For example, when V3−V4=10V, and the allowable limit for variation is approximately 10%, 1V which correspond to approximately 10% is the threshold voltage Vth.

If the time Tw for ΔVs to become the threshold voltage Vth is set to Tx, Tx is 30 ms from the graph of FIG. 7. If the time Tw for applying the voltage for writing the image on the liquid crystal layer is set to be greater than or equal to 30 ms, ΔVs will be less than or equal to the threshold voltage Vth, and a stable image in which there is little change in the written image due to temperature change can be written in the temperature range of 0° C.-50° C.

Though this discussion varies a bit depending on the target level of tone expression, in the case of the active matrix driving in which the writing voltage is applied after resetting to the planar state, it is confirmed that a level of display quality that can be appreciated could not be maintained without temperature compensation if ΔVs exceeds 10% of the difference between the maximum value and the minimum value of the writing voltage.

The maximum value and the minimum value of the writing voltage mentioned above are writing voltages set for obtaining the practically desired maximum (or minimum) and minimum (or maximum) reflectances (for example, V3 and V4 in FIG. 2). Further, the relationship between high or low of the voltage applied and high or low of the reflectance obtained is reversible as shown in FIG. 2 depending on whether the initial state of the liquid crystal is planar state or focal conic state. Accordingly abovementioned "ΔVs exceeds 10% of the difference between the maximum value and the minimum value of the writing voltage" means that ΔVs exceeds 10% of the range of the driving voltage practically set.

As described above, by setting Tw to be Tx or greater, in this embodiment to be 30 ms or longer, ΔVs will be less that or equal to the predetermined threshold voltage Vth and there will be little change in reflectance for the writing voltage due to temperature change, and favorable image quality can be obtained without performing temperature compensation. On the other hand, even if Tw is more than or equal to 30 ms, ΔVs shows great changes outside the range from 0° C. to 50° C. which is not shown, and in the case of use outside the range from 0° C. to 50° C., additional temperature compensation is necessary. It is to be noted that the temperature range is not limited to 0° C. to 50° C., and Tx at which ΔVs becomes Vth from 10° C. to 40° C. for example may be used.

Next the stack type liquid crystal display panel 50 will be described as example 2.

Figure 8:
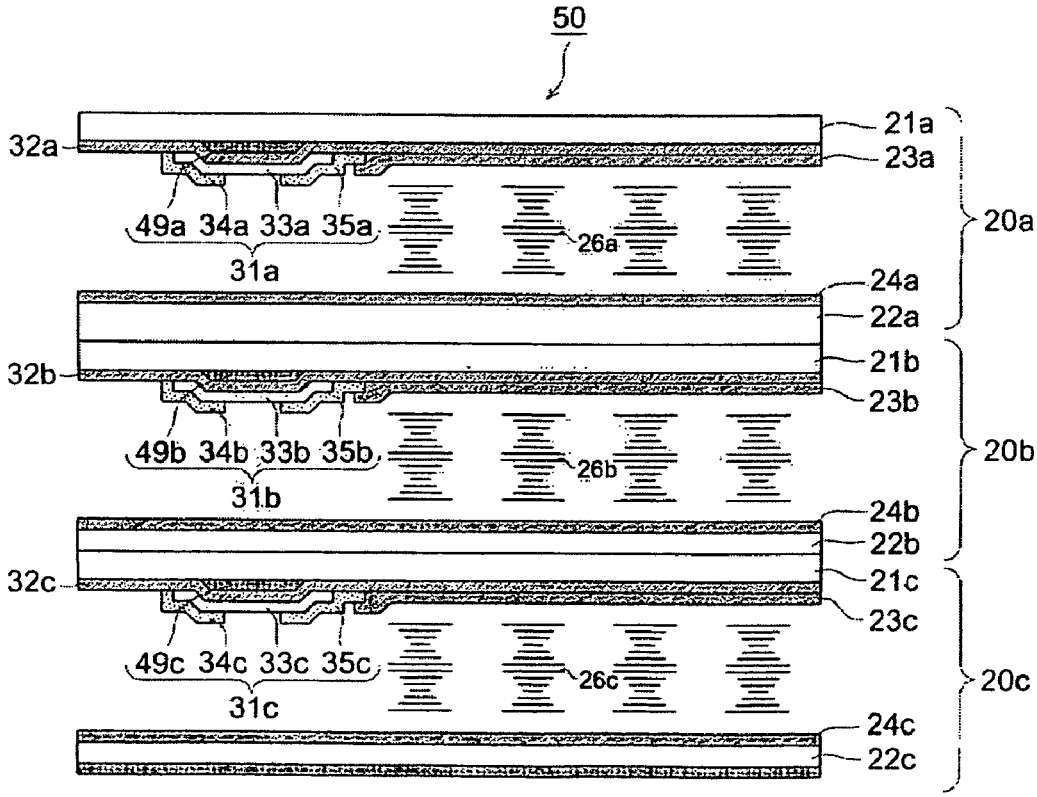
FIG. 8 is a cross-sectional view showing the configuration of the stack type liquid crystal display panel 50 of the example 2 of the present invention.

FIG. 8 is a cross-sectional view of the stack type liquid crystal display panel 50 of the working example 2 of the present invention.

In the stack type liquid crystal display panel 50, a plurality of the liquid crystal display panels 20 described in FIG. 3 are stacked and color images are displayed. Each of the liquid crystal layers 26 of the liquid crystal display panel 20 are colored and color images are expressed by reflection of light of wavelengths corresponding to the image. In this example, three liquid crystal display panels 20 are stacked as shown in FIG. 8 which is one example. The liquid crystal display panel 20 is the same as that described in FIG. 3 except that the liquid crystal display panel 20 and the liquid crystal layer 26 are colored. The letters a, b and c are assigned to the colored liquid crystal display panels and the liquid crystal layers to distinguish them. That is to say, they are shown as liquid crystal display panel 20*a*, liquid crystal display panel 20*b*, liquid crystal display pannel 20*c*, liquid crystal layer 26*a*, liquid crystal layer 26*b*, and liquid crystal layer 26*c*. It is to be noted that the other structural elements which have the same functions are assigned the same numbers as in FIG. 3 and descriptions thereof have been omitted.

A liquid crystal material showing selective reflection of blue is used to fill the liquid crystal layer 26*a;* a liquid crystal material showing selective reflection of green is used to fill the liquid crystal layer 26*b;* and a liquid crystal material showing selective reflection of red is used to fill the liquid crystal layer 26*c*.

It is to be noted that in this working example, the opposing substrate 22*a* and the matrix substrate 21*b*, and the opposing substrate 22*b* and the matrix substrate 21*c* are separate substrates formed of the liquid crystal display panel 20*a*, 20*b* and 20*c*, but the opposing substrate 22*a* and the matrix substrate 21*b*, or the opposing substrate 22*b* and the matrix substrate 21*c* for example, may be formed as a single substrate without compromising the effects of this embodiment.

EXAMPLE 2

Example 2 which was performed for confirming the effects of this embodiment will be described in the following.

The experimental conditions are basically the same as those of example 1.

[Fabrication of the Liquid Crystal Panel]

<Fabrication of the Blue Layer: Liquid Crystal Display Panel 20*a*>

The liquid crystal material is prepared by sufficiently mixing 48.0 weight % of nematic liquid crystals BL012 (manufactured by Merck & Co., Inc.) with positive dielectric anisotropy, 26.0 weight % of dextrorotatory chiral agent CB15 (manufactured by Merck & Co., Inc.) and 26.0 weight % of dextrorotatory chiral agent CE2 (manufactured by Merck & Co., Inc.) to form a dextrorotatory blue reflective liquid crystal composition.

Next the formed active matrix substrate 21 of the pixel electrode 23 that was prepared in advance and the formed opposing substrate 22 of the common electrode 24 are used and the substrates are adhered with a substrate interval of 4 μm and then the blue reflective liquid crystal composition is used for filling using a vacuum injection method to thereby create the blue reflective liquid crystal layer 26*a*.

In this manner, the liquid crystal display panel 20*a* that is prepared in this manner has reflection wavelength characteristics with a peak of approximately 450 nm in the planar state.

<Fabrication of the Green Layer: Liquid Crystal Display Panel 20*b*>

The liquid crystal material is prepared by sufficiently mixing 78.0 weight % of nematic liquid crystals ZLI-1565 (manufactured by Merck & Co., Inc.) with positive dielectric anisotropy, 14.0 weight % of dextrorotatory chiral agent CB15 (manufactured by Merck & Co., Inc.) and 5.0 weight % of dextrorotatory chiral agent R-1011 (manufactured by Merck & Co., Inc.) to form a dextrorotatory green reflective liquid crystal composition.

Next the formed active matrix substrate 21 of the pixel electrode 23 that was prepared in advance and the formed opposing substrate 22 of the common electrode 24 are used and the substrates are adhered with a substrate interval of 4 μm and then the green reflective liquid crystal composition is used for filling using a vacuum injection method to thereby create the green reflective liquid crystal layer 26*b*.

The liquid crystal display panel 20*b* that is prepared in this manner has reflection wavelength characteristics with a peak of approximately 550 nm in the planar state.

<Fabrication of the Red Layer: Liquid Crystal Display Panel 20*c*>

The liquid crystal material is prepared by sufficiently mixing 72.0 weight % of nematic liquid crystals BL012 (manufactured by Merck & Co., Inc.) with positive dielectric anisotropy, 14.0 weight % of dextrorotatory chiral agent CB15 (manufactured by Merck & Co., Inc.) and 14.0 weight % of dextrorotatory chiral agent CE2 (manufactured by Merck & Co., Inc.) to form a dextrorotatory red reflective liquid crystal composition.

Next the formed active matrix substrate 21 of the pixel electrode 23 that was prepared in advance and the formed opposing substrate 22 of the common electrode 24 are used and the substrates are adhered with a substrate interval of 4 μm and then the red reflective liquid crystal composition is used for filling using a vacuum injection method to thereby create the red reflective liquid crystal layer 26*c*.

The liquid crystal display panel 20*c* that is prepared in this manner has reflection wavelength characteristics with a peak of approximately 650 nm in the planar state.

[Experiment Conditions]

After the erasing period described in FIG. 5, pulse voltage is applied successively to the FET 31 of the gate lines G1, G2 and G3 from the timing T3 for the liquid crystal display panel 20*a*, the liquid crystal display panel 20*b* and the liquid crystal display panel 20*c* respectively, and voltage Vs (x, y) is successively applied to each of the pixel electrodes.

Vs (x, y) is set at the same voltage for each of the pixel electrodes and is in the range of 10-40V and changed by 0.2 V at a time and the reflectance of the entire stack type liquid crystal display panel 50 is measured.

Measurement temperatures: 0° C., 25° C., 50° C.

[Experimental Results]

Figure 9:
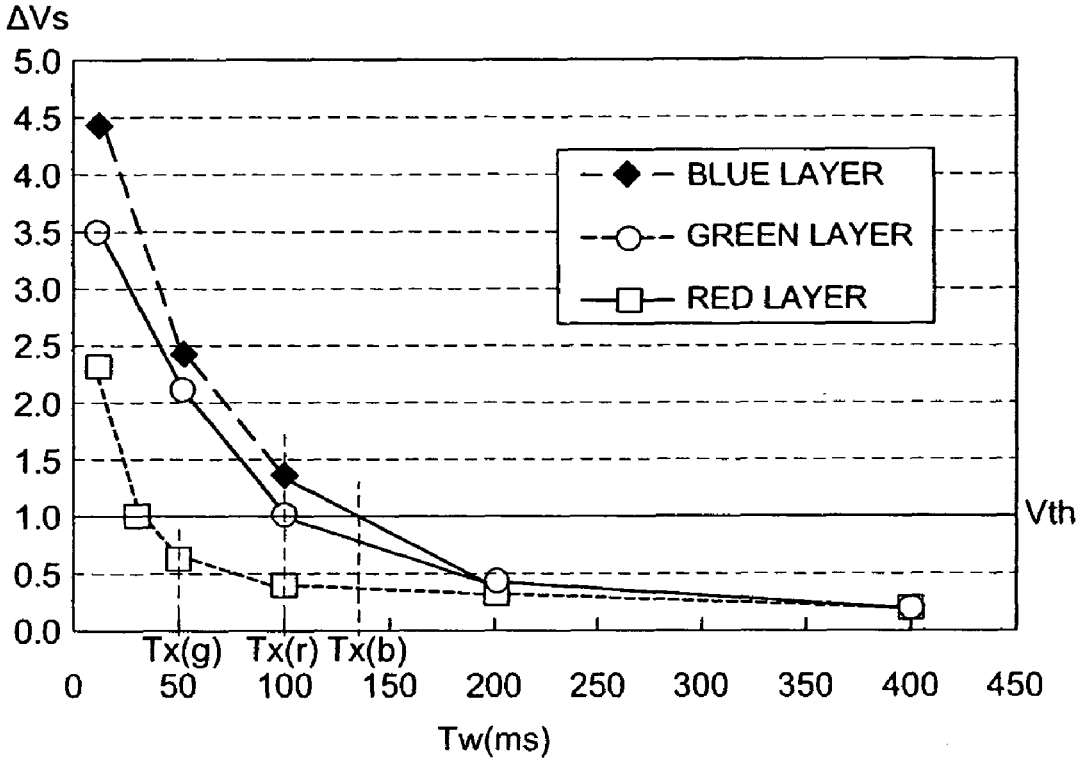
FIG. 9 shows experimental results which show the relationship between Tw and ΔVs of each liquid crystal display panel 20 example 2 of the present invention.

The experimental results are shown in FIG. 9.

FIG. 9 shows experimental results which show the relationship between Tw and ΔVs of each liquid crystal display panel 20 example 2 of the present invention.

The time Tw for applying the voltage for writing an image on the liquid crystal layer is changed within the range from 10 ms to 400 ms and ΔVs is measured.

Next the threshold Vth is set to 1V and the Tx of each liquid crystal display panel 20 is determined. The Tx of the liquid crystal display panel 20*a* showing blue is called Tx (b); the Tx of the liquid crystal display panel 20*b* showing green is called Tx (g); and the Tx of the liquid crystal display panel 20*c* showing red is called Tx (r). From FIG. 9 it can be seen that Tx (g)=30 ms, Tx (r)=100 ms and Tx (b)=120 ms and thus the Tx value for each of the liquid crystal display panels is different.

In the stack type liquid crystal display panel, if erasing of the images, writing of the images and displaying of the images on the liquid crystal display panels are not performed simultaneously, the display of image is ugly to view because of flicker. Also, if the time Tw for applying the voltage for writing images on the liquid crystal display layer is not set to be the same time at each of the liquid crystal display panels, flickering occurs. For this reason, Tx is set to be Tw which is greater than the longest Tx of the liquid crystal display panel, and all the stack type liquid crystal display panels are driven. In this example, Tx (b) of the blue liquid crystal display panel is 120 ms and is the longest, and thus if Tw is set for example to 200 ms which is greater than Tx (b), all of the red, blue and green liquid crystal display panels can be driven under the same conditions.

In this manner, by setting Tw to be more than the maximum Tx of the liquid crystal display panels, there will be little changes in reflectance for the writing voltage due to temperature change in all of the liquid crystal panels, and favorable image quality may be obtained without temperature compensation.

As described above, in this embodiment, by setting the time for executing the image writing period to be suitable, temperature compensation is unnecessary and image quality is not affected by the temperature changes in the surrounding environment, and thus a liquid crystal display panel and a stack type liquid crystal display panel with high image quality can be provided at low cost.

According to this embodiment of the present invention, the time Tw for applying voltage to the liquid crystal layer at the time of image writing is set so that the variation ΔVs depending on temperature of the writing voltage which makes the liquid crystal layer to show approximate 50% of the maximum reflectance is less than or equal to a predetermined value. As a result, a favorable display which is unlikely to be affected by environmental temperature becomes possible and thus temperature compensation for the liquid crystal display panel becomes unnecessary and a liquid crystal display panel with high image quality can be provided at low cost.

While the preferred embodiments of the present invention have been described using specific terms, such description is for illustrative purpose only, and it is to be understood that changes and variations may be made without departing from the spirit or scope of the appended claims.

What is claimed is:

1. A liquid crystal display panel, comprising:

pixel electrodes which are arranged in a two-dimensional matrix;

an active matrix substrate which includes switching elements arranged in a matrix in a one-to-one relationship with the pixel electrodes to control application and interruption of a voltage to the pixel electrodes;

an opposing substrate which includes a common electrode opposing the pixel electrodes; and a liquid crystal layer disposed between the pixel electrodes and the common electrode, the liquid crystal layer showing cholesteric phase at a temperature of 25° C., wherein different voltages are applied to the liquid crystal layer in each of 1) an image erasing period, 2) an image writing period and 3) an image displaying period, and thereby a state of the liquid crystal layer is changed in an order of erasing an image, writing an image and displaying an image, wherein a first time period Tw of applying a writing voltage, wherein the writing voltage has a value that ranges from a maximum voltage Vh for writing a desired maximum reflectance for the liquid crystal layer at a predetermined temperature to a minimum voltage V1 for writing a desired minimum reflectance for the liquid crystal layer at the predetermined temperature, to the liquid crystal layer during the image writing period, wherein the first time period is set to be at least as long as a second time period of applying the writing voltage to the liquid crystal layer in which ΔVs for the second time period is less than or equal to a predetermined value, wherein ΔVs is defined to be an absolute value of a difference of 1) a first writing voltage for obtaining approximately 50% of a maximum reflectance for the liquid crystal layer at 40° C. and 2) a second writing voltage for obtaining approximately 50% of a maximum reflectance for the liquid crystal layer at 10° C., wherein the predetermined value is 10% of an absolute difference between Vh and Vl.

2. The liquid crystal display panel of claim 1, wherein the writing voltage which is applied to the liquid crystal layer to make the liquid crystal layer display an image of a predetermined reflectance is constant throughout a predetermined temperature range defined as being between 10° C. and 40° C.

3. The liquid crystal display panel of claim 1, wherein a state of the liquid crystal layer after the image erasing period is a planar state.

4. The liquid crystal display panel of claim 1, wherein a time period Tw is greater than or equal to 30 ms.

5. A stack type liquid crystal display panel, comprising:

a first liquid crystal display panel comprising:

pixel electrodes which are arranged in a two-dimensional matrix;

an active matrix substrate which includes switching elements arranged in a matrix in a one-to-one relationship with the pixel electrodes to control application and interruption of a voltage to the pixel electrodes;

an opposing substrate which includes a common electrode opposing the pixel electrodes; and a liquid crystal layer disposed between the pixel electrodes and the common electrode, the liquid crystal layer showing cholesteric phase at a temperature of 25° C., wherein different voltages are applied to the liquid crystal layer in each of 1) an image erasing period, 2) an image writing period and 3) an image displaying period, and thereby a state of the liquid crystal layer is changed in an order of erasing an image, writing an image and displaying an image, wherein a first time period Tw of applying a writing voltage to the liquid crystal layer during the image writing period is set longer than or equal to a second time period for applying the writing voltage to the liquid crystal layer in which a variation ΔVs is less than or equal to a predetermined value, wherein ΔVs for the second time period is defined to be an absolute value of a difference of 1) a first writing voltage for obtaining approximately 50% of a maximum reflectance for the liquid crystal layer at a first predetermined temperature and 2) a second writing voltage for obtaining approximately 50% of a maximum reflectance for the liquid crystal layer at a second predetermined temperature; and a second liquid crystal display panel stacked on said first liquid crystal panel, wherein said second liquid crystal display has a structure substantially identical to said first liquid crystal panel; and wherein the time period Tw of applying the writing voltage to the liquid crystal layers of the stacked liquid crystal display panels is the same for all of the stacked liquid crystal display panels.

6. A liquid crystal display panel, comprising:

pixel electrodes which are arranged in a two-dimensional matrix;

an active matrix substrate which includes switching elements arranged in a matrix in a one-to-one relationship with the pixel electrodes to control application and interruption of a voltage to the pixel electrodes;

an opposing substrate which includes a common electrode opposing the pixel electrodes; and a liquid crystal layer disposed between the pixel electrodes and the common electrode, the liquid crystal layer showing cholesteric phase at a temperature of 25° C., wherein different voltages are applied to the liquid crystal layer in each of 1) an image erasing period for resetting the liquid crystal layer included in an area for writing into a predetermined state so as to erase an image, 2) an image writing period for writing an image and 3) an image displaying period for displaying an image, wherein a first time period Tw of applying a writing voltage, wherein the writing voltage has a value that ranges from a maximum voltage Vh for writing a desired maximum reflectance for the liquid crystal layer at a predetermined temperature to a minimum voltage Vl for writing a desired minimum reflectance for the liquid crystal layer at the predetermined temperature, to the liquid crystal layer during the image writing period and wherein the first time period is set longer than or equal to a second time period for applying the writing voltage to the liquid crystal layer in which ΔVs for the second time period is equal to a predetermined value and wherein ΔVs is defined to be an absolute value of a difference of 1) a first writing voltage for obtaining approximately 50% of a maximum reflectance for the liquid crystal layer at 50° C. and 2) a second writing voltage for obtaining approximately 50% of a maximum reflectance for the liquid crystal layer at 0° C., wherein the predetermined value is 10% of an absolute value of a difference between the maximum writing voltage Vh and the minimum writing voltage Vl.

7. The liquid crystal display panel of claim 6, wherein a state of the liquid crystal layer after the image erasing period is a planar state.

8. The liquid crystal display panel of claim 6, wherein a time period Tw is greater than or equal to 30 ms.

9. A stack type liquid crystal display panel, comprising:

a first liquid crystal display panel, comprising:

pixel electrodes which are arranged in a two-dimensional matrix;

an active matrix substrate which includes switching elements arranged in a matrix in a one-to-one relationship with the pixel electrodes to control application and interruption of a voltage to the pixel electrodes;

an opposing substrate which includes a common electrode opposing the pixel electrodes; and a liquid crystal layer disposed between the pixel electrodes and the common electrode, the liquid crystal layer showing cholesteric phase at a temperature of 25° C., wherein different voltages are applied to the liquid crystal layer in each of an image erasing period for resetting the liquid crystal layer included in an area for writing into a predetermined state so as to erase an image, an image writing period for writing an image and an image displaying period for displaying an image, wherein a first time period Tw of applying a writing voltage to the liquid crystal layer during the image writing period is set longer than or equal to a second time period in which a difference between the writing voltage at 0° C. and the writing voltage at 50° C., both voltages for making the liquid crystal layer display an image of approximate 50% of a maximum reflectance and in which a 10% of a difference between a maximum and minimum writing voltages at a temperature of 25° C. exists;

a second liquid crystal display panel stacked on said first liquid crystal panel, wherein the second liquid crystal display has a structure substantially identical to the first liquid crystal panel; and wherein the first time period Tw of applying the writing voltage to the liquid crystal layers of the stacked liquid crystal display panels is the same for all of the stacked liquid crystal display panels.

10. A driving method for a liquid crystal display panel comprising:

pixel electrodes arranged in a two-dimensional matrix, an active matrix substrate including switching elements arranged in a matrix in a one-to-one relationship with the pixel electrodes to control-application and interruption of a voltage to the pixel electrodes, an opposing substrate including a common electrode opposing the pixel electrodes, and a liquid crystal layer disposed between the pixel electrodes and the common electrode, the liquid crystal layer showing cholesteric phase at a temperature of 25° C., the driving method comprising:

applying an erase voltage to the liquid crystal layer to erase an image;

applying a writing voltage to the liquid crystal layer to write an image, wherein the writing voltage has a value that ranges from a maximum voltage Vh for writing a desired maximum reflectance for the liquid crystal layer at a predetermined temperature to a minimum voltage Vl for writing a desired minimum reflectance for the liquid crystal layer at the predetermined temperature;

applying a display voltage to the liquid crystal layer to display an image; wherein a first time period Tw of applying the writing voltage to the liquid crystal layer is set to be longer than or equal to a second time period for applying the writing voltage to the liquid crystal layer in which a variation ΔVs for the second time period is a predetermined value, wherein ΔVs is defined to be an absolute value of a difference of 1) a first writing voltage for obtaining approximately 50% of a maximum reflectance for the liquid crystal layer at 40° C. and 2) a second writing voltage for obtaining approximately 50% of a maximum reflectance for the liquid crystal layer at 10° C., wherein the predetermined value is 10% of an absolute difference between Vh and Vl.

11. The driving method of claim 10, wherein the writing voltage which is applied to the liquid crystal layer to make the liquid crystal layer display an image of a predetermined reflectance is constant throughout a predetermined temperature range defined as being between 10° C. and 40° C.

12. The driving method of claim 10, wherein a state of the liquid crystal layer after the image erasing period is a planar state.

13. The driving method of claim 10, wherein the time period Tw is greater than or equal to 30 ms.

14. The driving method of claim 10, further comprising:

providing a second liquid crystal display panel stacked together with the liquid crystal display, wherein the second liquid crystal display panel comprises: second pixel electrodes arranged in a two-dimensional matrix, a second active matrix substrate including second switching elements arranged in a matrix in a one-to-one relationship with the second pixel electrodes to control application and interruption of a voltage to the second pixel electrodes, a second opposing substrate including a second common electrode opposing the second pixel electrodes, and a second liquid crystal layer disposed between the second pixel electrodes and the second common electrode, the second liquid crystal layer showing cholesteric phase at a temperature of 25° C., the driving method further comprising:

applying the erase voltage to the second liquid crystal layer to erase an image;

applying the writing voltage to the second liquid crystal layer to write an image;

applying the display voltage to the liquid crystal layer to display an image; wherein a time period of applying the writing voltage to the second liquid crystal layer is the same as the time period Tw of applying the writing voltage to the liquid crystal layer.

15. The driving method of claim 10, wherein the first predetermined temperature 0° C. and the second predetermined temperature is 50° C., and the predetermined value of the ΔVs is less than or equal to 10% of a difference between a maximum voltage and a minimum voltage at a temperature of 25° C.

16. The liquid crystal display panel of claim 1, wherein the time period Tw is set to a constant value throughout a predetermined temperature range defined as being between 10° C. and 40° C.

17. The liquid crystal display panel of claim 6, wherein the time period Tw is set to a constant value throughout a predetermined temperature range defined as being between 0° C. and 50° C.

18. The liquid crystal display panel of claim 10, wherein the time period Tw is set to a constant value throughout a predetermined temperature range defined as being between 10° C. and 40° C.

* * * * *